US009269522B2

(12) United States Patent
Lee et al.

(10) Patent No.: US 9,269,522 B2
(45) Date of Patent: Feb. 23, 2016

(54) ELECTRIC FIELD EMITTING SOURCE, ELEMENT USING SAME, AND PRODUCTION METHOD THEREFOR

(71) Applicant: Korea University Research and Business Foundation, Seoul (KR)

(72) Inventors: Cheol Jin Lee, Seoul (KR); Dong Hoon Shin, Seoul (KR); Ji Hong Shin, Seoul (KR)

(73) Assignee: KOREA UNIVERSITY RESEARCH AND BUSINESS FOUNDATION, Seoul (KR)

( * ) Notice: Subject to any disclaimer, the term of this patent is extended or adjusted under 35 U.S.C. 154(b) by 10 days.

(21) Appl. No.: 14/152,045

(22) Filed: Jan. 10, 2014

(65) Prior Publication Data

US 2014/0191650 A1 Jul. 10, 2014

Related U.S. Application Data

(63) Continuation of application No. PCT/KR2012/005480, filed on Jul. 11, 2012.

(30) Foreign Application Priority Data

Jul. 11, 2011 (KR) ..... 10-2011-0068553

(51) Int. Cl.

| | |
|---|---|
| ***H01J 9/02*** | (2006.01) |
| ***H01J 19/24*** | (2006.01) |
| ***H01J 1/304*** | (2006.01) |
| ***H01J 3/02*** | (2006.01) |

(52) U.S. Cl.

CPC ..... *H01J 19/24* (2013.01); *H01J 1/304* (2013.01); *H01J 3/021* (2013.01); *H01J 9/025* (2013.01)

(58) Field of Classification Search

CPC ..... H01J 9/24; H01J 1/304; H01J 9/025; H01J 3/021

See application file for complete search history.

(56) References Cited

U.S. PATENT DOCUMENTS

| | | | | |
|---|---|---|---|---|
| 5,386,172 | A * | 1/1995 | Komatsu | H01J 1/3042 313/309 |
| 5,502,314 | A * | 3/1996 | Hori | H01J 9/025 257/10 |
| 2005/0136788 | A1* | 6/2005 | Fink | 445/51 |
| 2006/0192476 | A1* | 8/2006 | Wei et al. | 313/495 |
| 2007/0029912 | A1* | 2/2007 | Park et al. | 313/310 |
| 2007/0111628 | A1* | 5/2007 | Yagi et al. | 445/24 |
| 2012/0135233 | A1* | 5/2012 | Ivanov et al. | 428/367 |
| 2012/0194058 | A1* | 8/2012 | Wei et al. | 313/496 |

FOREIGN PATENT DOCUMENTS

| | | | |
|---|---|---|---|
| KR | 10-2000-0071254 | A | 11/2000 |
| KR | 10-2007-0062710 | A | 6/2007 |

OTHER PUBLICATIONS

International Search Report for PCT/KR2012/005480 dated Dec. 12, 2012.

* cited by examiner

*Primary Examiner* — Donald Raleigh
(74) *Attorney, Agent, or Firm* — Pearne & Gordon LLP

(57) ABSTRACT

An electric field emitting source is equipped with an electron emitting film which comprises a nano-sized electron emitting substance and has a first surface and a second surface constituting the surface opposite thereto, and a cathode which secures one end of the electron emitting film and comprises a first block and a second block respectively corresponding to the first surface and the second surface of the electron emitting film.

11 Claims, 26 Drawing Sheets

ELECTRIC FIELD EMITTING SOURCE, ELEMENT USING SAME, AND PRODUCTION METHOD THEREFOR

CROSS-REFERENCE TO RELATED APPLICATION

This application claims the benefit of Korean Patent Application No. 10-2011-0068553 filed on Jul. 11, 2011 and PCT Patent Application No. PCT/KR2012/005480 filed on Jul. 11, 2012, the entire disclosures of which are incorporated herein by reference.

FIELD OF THE INVENTION

The present disclosure relates to a field emission source and a field emission device, in particular, a field emission device using a nano-material film and a production method thereof.

BACKGROUND OF THE INVENTION

Conventional methods for producing a field emission source by using a nano-sized electron emission material (hereinafter, referred to as "nano-material") in a particle or rod form can be divided into a method for growing a nano-material directly on a cathode substrate [(Science vol. 283, 512, 1999), (Chemical Physics Letters. 312, 461, 1999), (Chemical Physics Letters. 326, 175, 2000), (Nano Letter vol. 5, 2153, 2005), US006350488B1, US006514113B1], and a method for variously attaching a synthesized nano-material in a powder form onto a cathode substrate such as a suspension filtering method [(Science vol. 268, 845, 1995) and (Applied Physics Letters, vol. 73, 918, 1998], a screen printing method [(Applied Physics Letters vol. 75, 3129, 1999) and Korean Patent Application Publication No. 10-2007-0011808], electrophoresis [(Advanced Materials vol. 13, 1770, 2001), (Nano Letter vol. 6, 1569, 2006), US006616497 B1 and US20060055303A1], a self-assembling method [(Advanced Materials vol. 14, 8990, 2002) and US006969690B2], a spray method [(Mat. Res. Soc. Symp. Proc. vol. 593, 215, 2000), (Carbon vol. 44, 2689, 2006), (The Journal of Physical Chemistry C. 111, 4175, 2007), US006277318B1 and Korean Patent Application Publication No. 10-2007-0001769] and an inkjet printing method [(Small, vol. 2, 1021, 2006), (Carbon vol. 45, 27129, 2007) and US20050202578A1].

The directly growing method enables easy control of a structure of the nano-material such as control of a diameter, length, density and patterning, but is disadvantageous in that it is difficult to assure uniformity of catalyst metal deposition on a large area and control a size of catalyst metal particles, and adhesion between the grown nano-material and the cathode substrate is low. In order to overcome the problem in the adhesion between the nano-material and the cathode substrate, the difficulty in control of the physical properties and others as described above, methods for purifying, dispersing and functionalizing a nano-material in a powder form, which has been produced by various synthesis methods, so as to become a paste, and methods for attaching a suspension dispersed in a solvent and a surfactant onto various cathode substrates have been developed. Among those methods, the screen printing method, which fabricates a field electron structure by printing a paste composition containing nano-material powders, a polymer, a binder, an organic solvent, a metallic filler, other additives, etc., onto a cathode substrate and performing drying, exposing, sintering, surface-protrusion processes and others for the cathode substrate, provides superior adhesion between the cathode substrate and the field emission structure and is suitable for a large area. However, the screen printing method is disadvantageous in that it is difficult to control density of an active electron emission cite, the field electron emission characteristic is easily deteriorated due to various organic/inorganic binders and polymers, and processes are complicated.

The electrophoresis enables selective deposition at a room temperature and is easily applicable to a large area. However, since controlling thickness and density is difficult, uniformity and reproducibility are poor, and adhesion to the cathode substrate is low, there is a problem in reliability and stability when the electrophoresis is applied to field electron emission.

The self-assembling method has simple processes and is easily applicable to a large area at a room temperature. However, like the electrophoresis, the self-assembling method is disadvantageous in that the adhesion between the formed nano-material thin film and the cathode substrate is poor, and much time is needed.

The spray method also has simple processes and is easily applicable to a large area at a room temperature. However, since the thin film surface state is determined depending on a degree of evaporation of a suspension during movement of a spray droplet from a nozzle to the cathode substrate, control of thickness and density of a nano-material thin film and uniform deposition of a thin film are difficult. Accordingly, uniformity and reproducibility are deteriorated. Due to the low adhesion to the cathode substrate, detachment easily occurs during the field electron emission.

The inkjet printing method enables easy control of thickness and density, can realize selective patterning, and is suitable for a large area at a room temperature. However, the inkjet printing method is disadvantageous in that the adhesion between the printed nano-material and the cathode substrate is low.

BRIEF SUMMARY OF THE INVENTION

Some illustrative embodiments of the present disclosure have a purpose to provide a field emission source having a stable structure for supporting an electron emission material, a field emission device using the same, and a method for fabricating the field emission device.

In one aspect of the present invention, a field emission source comprises:

an electron emission film containing nano-sized electron emission materials and having a first surface and a second surface opposite to the first surface, and a cathode comprising a first block and a second block corresponding to the first surface and the second surface of the electron emission film, respectively, to fix one end of the electron emission film.

In accordance with another illustrative embodiment of the present invention, the cathode may be provided on both ends of the field emission film.

In accordance with detail illustrative embodiment of the present invention, at least one of the first and second blocks contains conductivity and is preferably formed of a metallic material.

In accordance with another illustrative embodiment of the present invention, the electron emission materials of the electron emission film are combined to one another through a molecular force without requiring a binder.

In accordance with another illustrative embodiment of the present invention, the field emission source further comprises a base that supports the first block, and the first surface of the field emission film is positioned in parallel with a surface of the base.

In another aspect of the present invention, a field emission device comprises:

an electron emission film containing nano-sized electron emission materials and having a first surface and a second surface opposite to the first surface, a cathode comprising a first block and a second block corresponding to the first surface and the second surface of the electron emission film, respectively, to fix one end of the electron emission film, a substrate that supports the cathode, and an anode formed on the other side of the substrate, facing to the electron emission film.

According to the method of the present invention, a method for fabricating a field emission device is provided for the method comprises:

forming a first block, which is an element of a cathode, on one side of a substrate, forming a sacrificial layer having a surface with the same height as that of the first block on a part, in which the first block is not formed, forming an electron emission film by using electron emission materials on a surface of the first block and a surface of the sacrificial layer, forming a second block corresponding to the first block on the electron emission film, and removing the sacrificial layer so that the electron emission film has a gap from the substrate, and fixing an end of the electron emission film in the state that it is inserted between the first and second blocks.

In accordance with one illustrative embodiment of the present invention, a gate is provided between the cathode and the anode.

The gate may be positioned at a lower portion of the electron passageway between the needle type-electron emission materials and the anode.

Also, the gate may have gate members provided at both sides of an electron passageway between the electron emission materials and the anode.

The anode may have the side surface that electrons from the electron emission materials collide.

The electron emission materials comprise one of the CNT, carbon nano-plate, nanowire, and Graphene.

According to the present disclosure, it is possible to obtain a field emission source, which can very firmly fix an electron emission structure, and an electron emission device using the same. This is achieved by producing an electron emission unit in a film form and fixing an end of the electron emission film by means of a first block and a second block of a cathode. According to the present disclosure, it is possible to obtain a field emission source and an electron emission device, which can realize a horizontal electron emission structure without requiring a spacer. Since the spacer that has been necessary in a conventional vertical structure is excluded, a process for forming the spacer can be omitted. Especially, since the whole structure is formed on one substrate, the entire production process can be reduced, compared to a conventional production process. In addition, since the structure is formed on one substrate, it is possible to obtain an integrated array structure of multiple field electron emission devices. If necessary, it is possible to produce a large number of individual field emission devices by separating the array into individual device units. As the field electron emission devices having the above-described structure, for example, there are lamps, display devices, backlight devices for flat panel displays and electron sources for high power microwaves. In addition, since independent driving of a selective individual device is possible, and connection between individual devices is possible, an integrated vacuum electron emission device in the similar form to that of a solid semiconductor device can be realized.

DETAILED DESCRIPTION OF THE INVENTION

Hereinafter, a fundamental structure of a field emission source in accordance with illustrative embodiments of the present disclosure will be described with reference to the accompanying drawings.

Figure 1A:
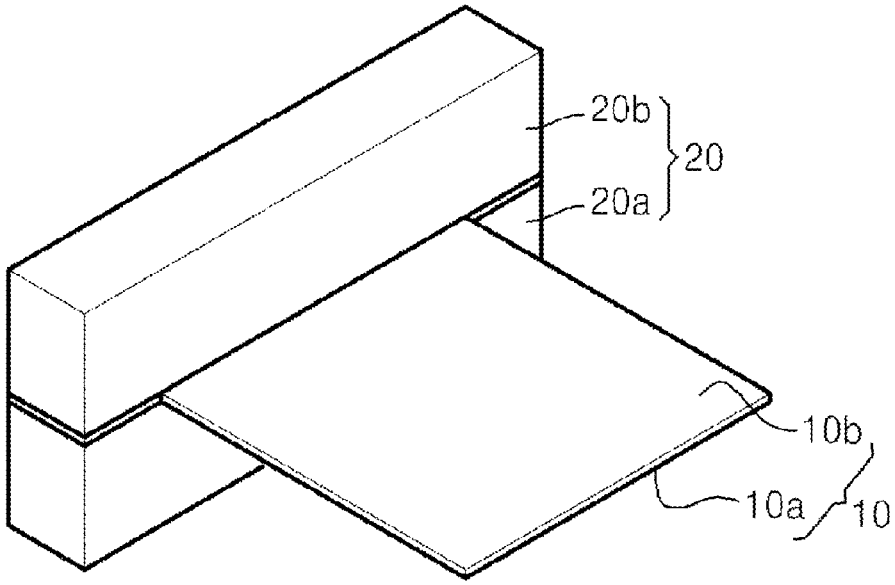
FIGS. 1*a* to 1*d* schematically illustrate field emission sources in accordance with various illustrative embodiments.
Figure 1B:
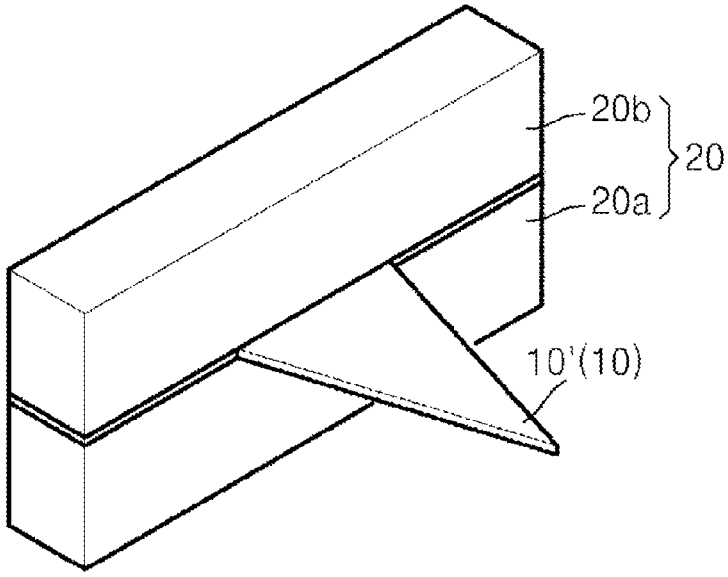
Figure 1C:
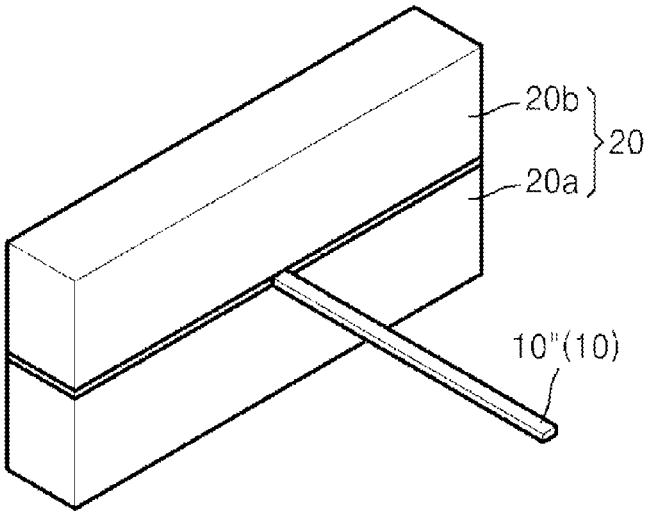
Figure 1D:
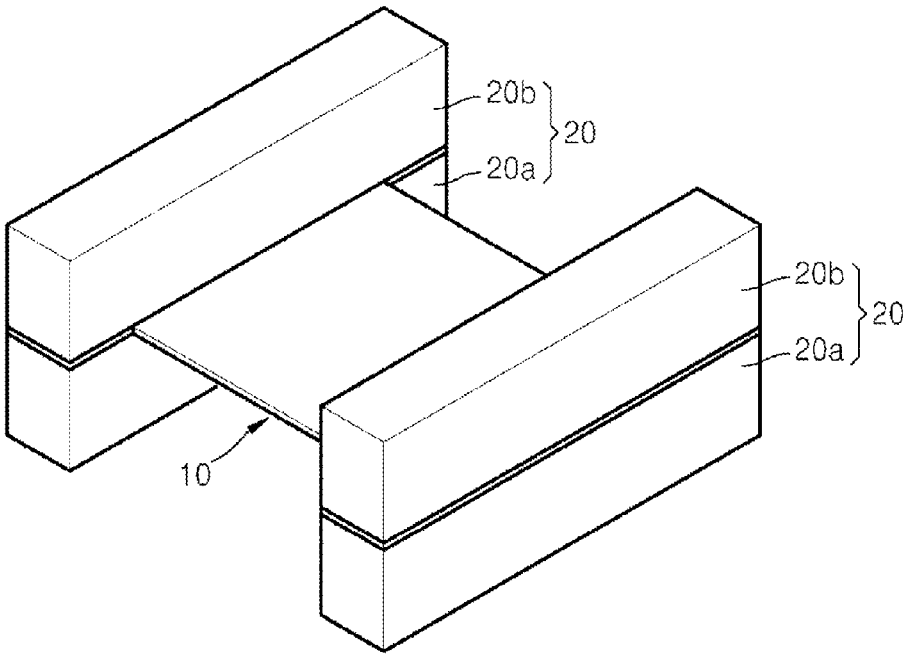

First, with reference to FIG. 1*a*, an electron emission film 10, which can be in various forms, is fixed to a cathode 20. In this case, the cathode 20 has a first block 20*a* and a second block 20*b*. One end of the electron emission film 10 is inserted between the first and second blocks 20*a* and 20*b*. The electron emission film 10 has a first surface 10*a* (the bottom surface in the drawing) and a second surface 10*b* (the top surface in the drawing) opposite to the first surface 10*a*. The first surface 10*a* of the electron emission film 10 is facing to the top surface of the first block 20*a*, and the second surface 10*b* of the electron emission film 10 is facing to the bottom surface of the second block 20*b*. In view of structure, since a certain width of one end of the electron emission film 10 is inserted between the first and second blocks 20*a* and 20*b*, the electron emission film 10, which is an electron emission structure, is very firmly fixed to the cathode 20. FIGS. 1*b* and 1*c* show other modified examples 10' and 10" for the electron emission film 10. The electron emission film 10' of FIG. 1*b* has a triangle shape, and the electron emission film 10" of FIG. 1*c* has an elongated strip shape. Meanwhile, FIG. 1*d* shows an example for an electron emission source having a structure, in which cathodes 20 are provided at both ends of the electron emission film 10. The electron emission film 10, 10' and 10" is formed of various electron emission materials such as CNT, nanowires or Graphene. The technical scope of the present disclosure is not limited to the certain electron emission film materials. Meanwhile, both the first and second blocks 20*a* and 20*b*, which are the elements of the cathode 20, may have conductivity. In accordance with another illustrative embodiment, only one of the first and second blocks 20*a* and 20*b* may have conductivity. In addition, each of the first and second blocks 20*a* and 20*b*, which fix one end or both ends of the electron emission film 10, 10' and 10", may have a structure of a single material or a multi-layer containing other functional elements. That is, the first block 20*a* and the first surface of the electron emission film 10, 10' and 10" may be directly contacted with each other, but one or more separate layers may exist between the first block 20*a* and the first surface of the electron emission film 10, 10' and 10". The second block 20*b* and the second surface of the electron emission film 10, 10' and 10" may also be directly contacted with each other, but one or more separate layers may exist between the second block 20*b* and the second surface of the electron emission film 10, 10' and 10". The above illustrative embodiment has described that both the first and second blocks, which form the cathode, are conductors. However, considering the technical idea of the present disclosure that the cathode is divided into two blocks, and one end of an electron emission film is fixed between the two blocks, one of the first and second blocks is a conductor, and the other may be formed of an insulating material as means for simply fixing the electron emission film, in accordance with another illustrative embodiment of the present disclosure. Although the illustrative embodiment described hereinafter describes that both the first and second blocks are conductors, it is obvious that one of the blocks may be an insulator as mentioned above, and the production process, which will be described later, needs to be partially changed.

FIGS. 2*a* to 2*f* schematically illustrate an example of a method for fabricating the above-described field emission source in a single unit form.

Figure 2A:
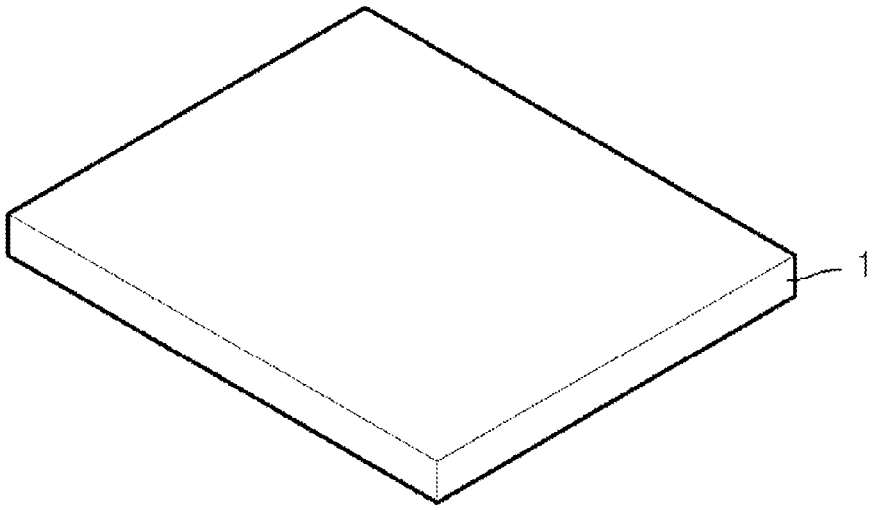
FIGS. 2*a* to 2*f* show an example of a method for fabricating a field emission source in accordance with an illustrative embodiment of the present disclosure.

As illustrated in FIG. 2*a*, a sacrificial substrate 1 having a flat surface is prepared. As the sacrificial substrate, flat materials in various forms such as a filter membrane, glass and alumina may be used.

Figure 2B:
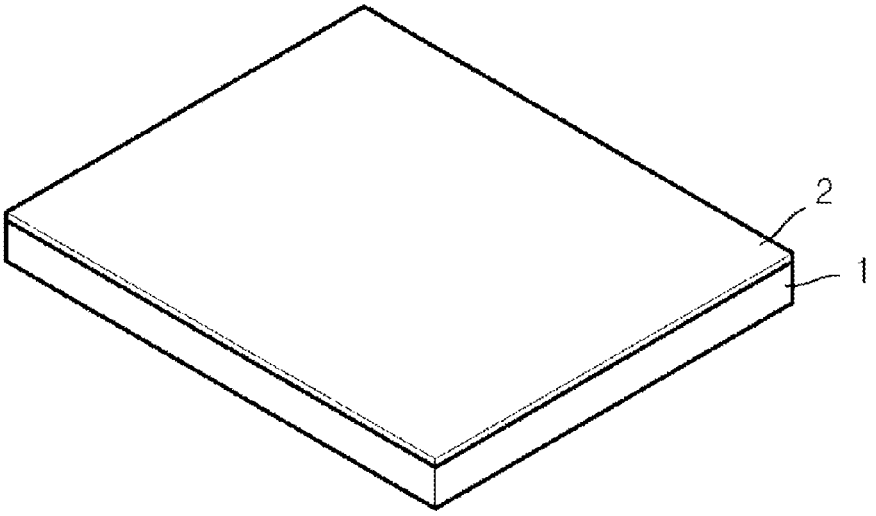

As illustrated in FIG. 2*b*, an electron emission film 2 is formed on the sacrificial substrate 1. To produce the electron emission film 2, various known methods, e.g., suspension filtering, a simple suspension coating method, electrophoresis and a transferring method may be applied. At this time, the electron emission film does not contain a binder for combining electron emission materials, and the electron emission materials are preferably combined to one another through a molecular force, i.e., the Van der Waals force.

As the electron emission materials, nano-sized materials, which enable electron emission under a field, e.g., CNT, nanowires and Graphene may be used.

As the sacrificial substrate 1, the filter membrane is used to produce an electron emission film through a suspension filtering method, and substrates such as glass and alumina are used to produce an electron emission film through suspension coating, electrophoresis or a transferring method.

Figure 2C:
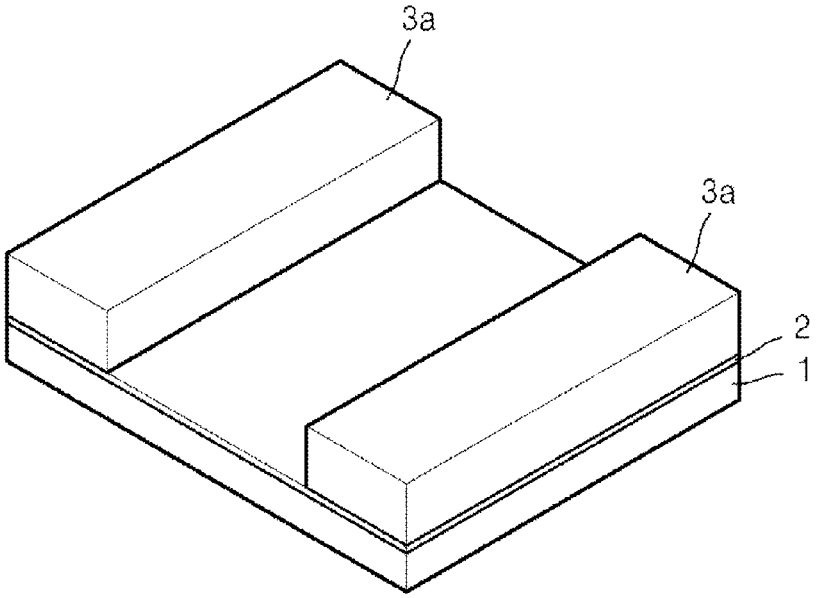

As illustrated in FIG. 2*c*, a first block 3*a*, which is an element of a cathode, is formed on the electron emission film 2 (the first surface thereof). The first block 3*a* is formed of a conductive material, e.g., metals such as Au and Ag. To produce the first block 3*a*, a film formation method, to which a general patterning method is applied, or a metal vacuum deposition method, which uses a pattern mask, may be used. As the film formation method, a thermal deposition method, an electron beam deposition method or physical deposition methods such as a sputtering method are suitable.

Figure 2D:
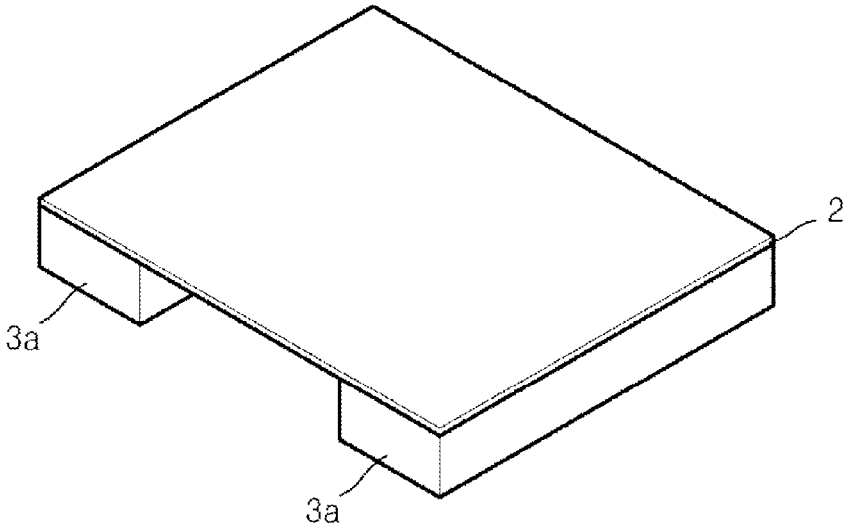
Figure 2E:
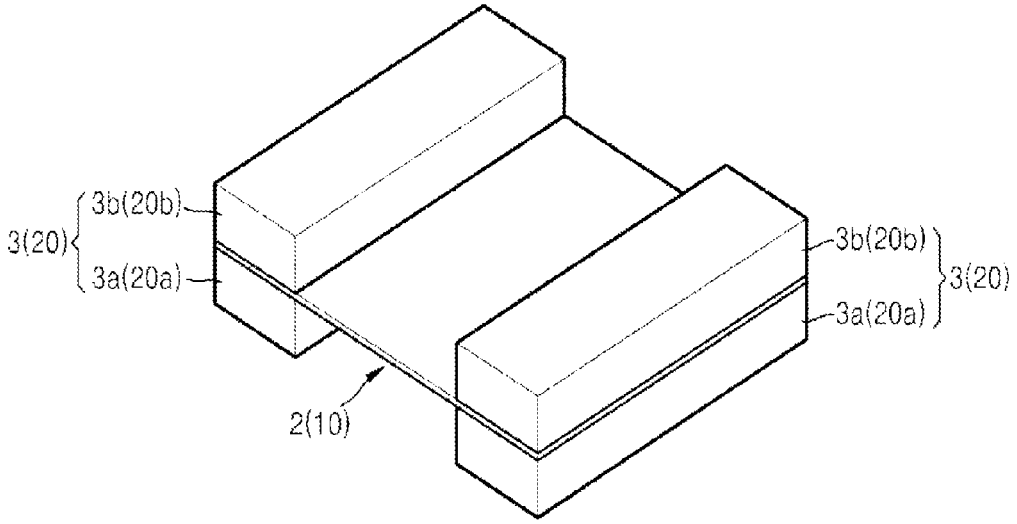
Figure 2F:
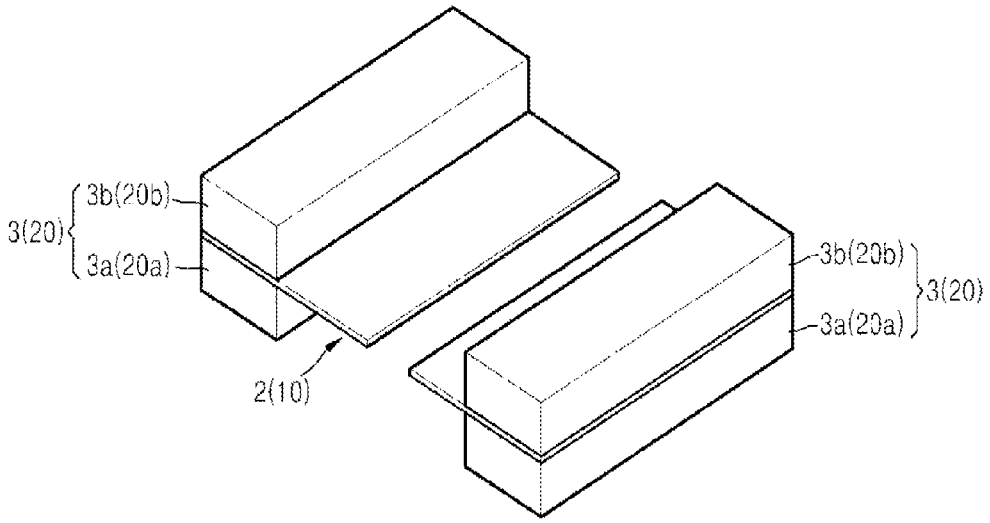

As illustrated in FIG. 2*d*, the sacrificial substrate 1, which has been used to produce the electron emission film 2, is removed. Thereafter, as illustrated in FIG. 2*e*, a second block 3*b* corresponding to the first block 3*a* of the first surface of the electron emission film 2 is formed on the surface (the second surface of the electron emission film 2), from which the sacrificial substrate 1 has been removed, and of the conductive material as described above. The field emission source having the structure illustrated in FIG. 2*e* is the above-described field emission source in the form illustrated in FIG. 1. In order to obtain the field emission source in the form illustrated in FIG. 1*a*, the center of the electron emission film 2 is cut as illustrated in FIG. 2*f*, and the electron emission film is mechanically processed to be in the form illustrated in FIGS. 1*b* and 1*c*. As the processing method, laser processing may be proper.

FIGS. 3*a* to 3*i* illustrate an example of a method for fabricating a diode-structure field emission device.

Figure 3A:
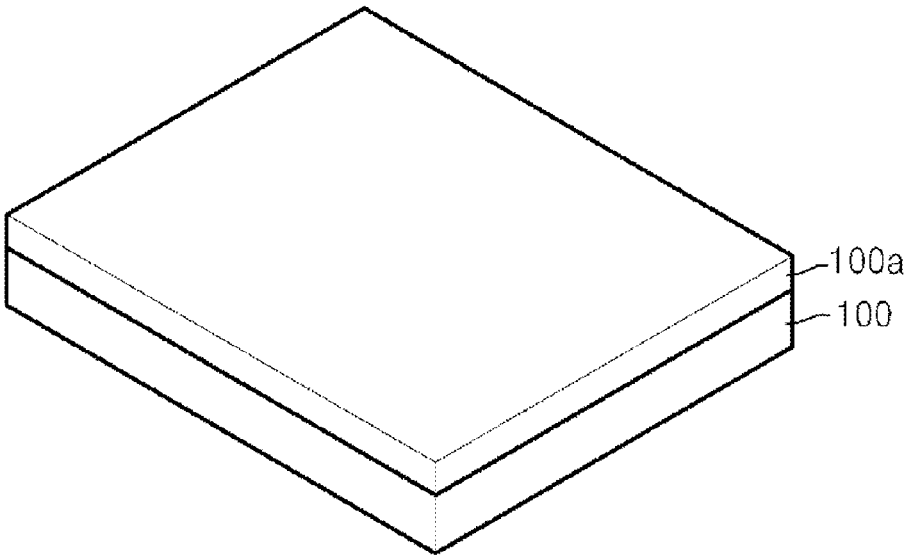
FIGS. 3*a* to 3*j* show an example of a method for fabricating an electron emission device in accordance with an illustrative embodiment of the present disclosure.

As illustrated in FIG. 3*a*, a silicon wafer 100 having a flat surface, on which a natural oxide film or an insulating layer 100*a* such as silicon dioxide ($SiO_2$) obtained from heat treatment to a silicon surface is formed, is prepared.

Figure 3B:
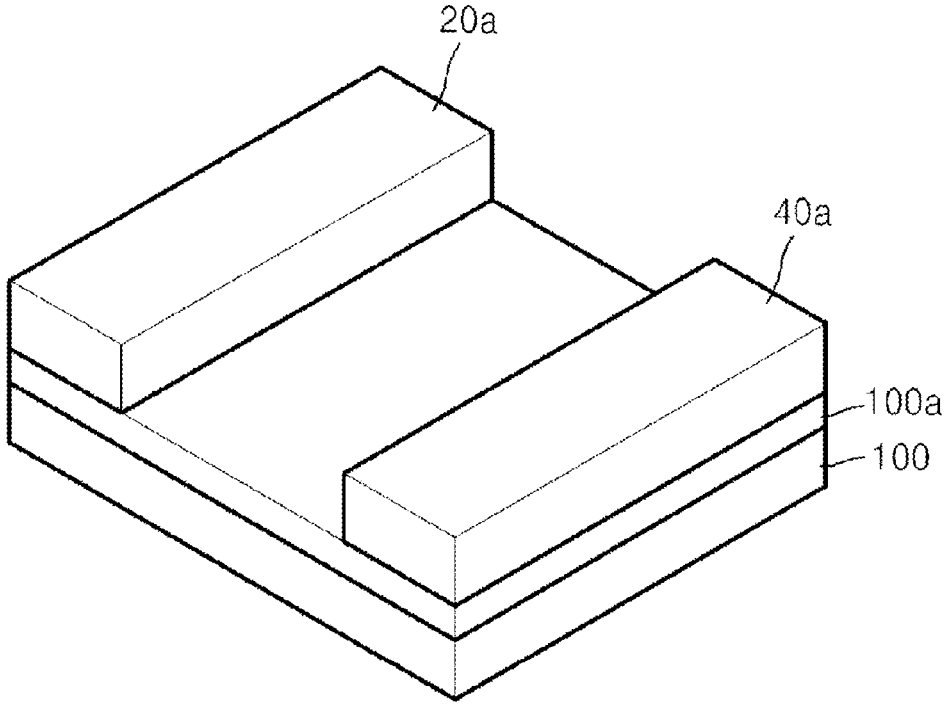

As illustrated in FIG. 3*b*, a first block 20*a*, which is an element of a cathode, and a first anode layer 40*a*, which is an element of an anode, are formed on both sides of the insulating layer 100*a*. At this time, the first block 20*a* and the first anode layer 40*a* are formed of the same conductive material, e.g., metals such as Au and Ag. To produce the first block 20*a* and the first anode layer 40*a*, a film formation method, to which a general patterning method is applied, a metal vacuum deposition method using a pattern mask or others may be used. As the film formation method, a thermal deposition method, an electron beam deposition method or physical deposition methods such as a sputtering method is proper.

Figure 3C:
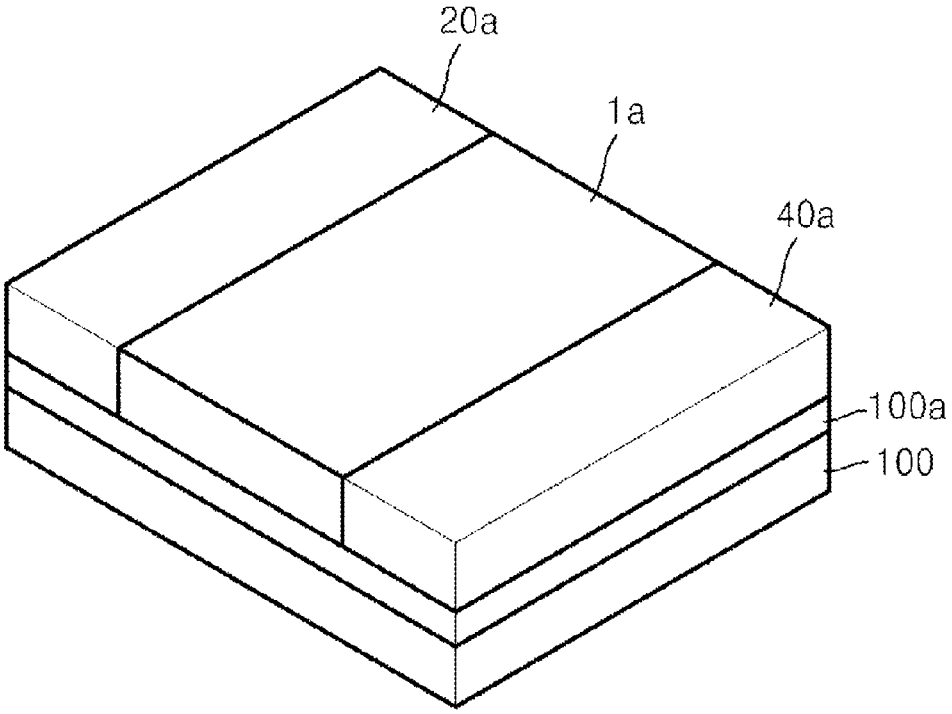

As illustrated in FIG. 3*c*, the space between the first block 20*a* and the first anode layer 40*a* is filled with insulating materials such as polymethyl metacrylate (PMMA) and silicon nitride (SiNx) to form a sacrificial layer 1*a*, which provides a flat surface between the first block 20*a* and the first anode layer 40*a*.

Figure 3D:
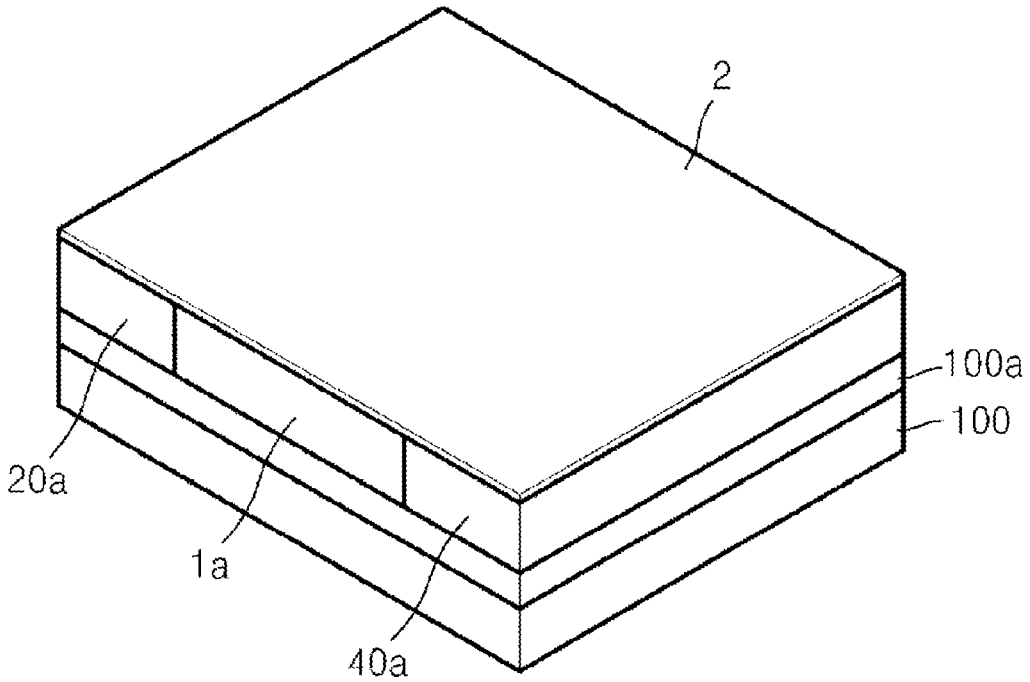

As illustrated in FIG. 3*d*, an electron emission film 2 in an initial form prior to completion is formed on the whole surface of the first block 20*a*, the first anode layer 40*a* and the sacrificial layer 1*a*. As mentioned above, to produce the electron emission film 2, various known methods, e.g., suspension filtering, a simple suspension coating method, electrophoresis and a transferring method may be applied. At this time, the electron emission film does not contain a binder for combining electron emission materials, and the electron emission materials are preferably combined to one another through a molecular force, i.e., the Van der Waals force. As the electron emission materials, nano-sized materials, which enable electron emission under a field, e.g., CNT, carbon nanoplates, nanowires and Graphene may be used. In accordance with another illustrative embodiment of the present disclosure, the electron emission film may contain a binder for combining electron emission materials, unlike the above-described illustrative embodiment.

Figure 3E:
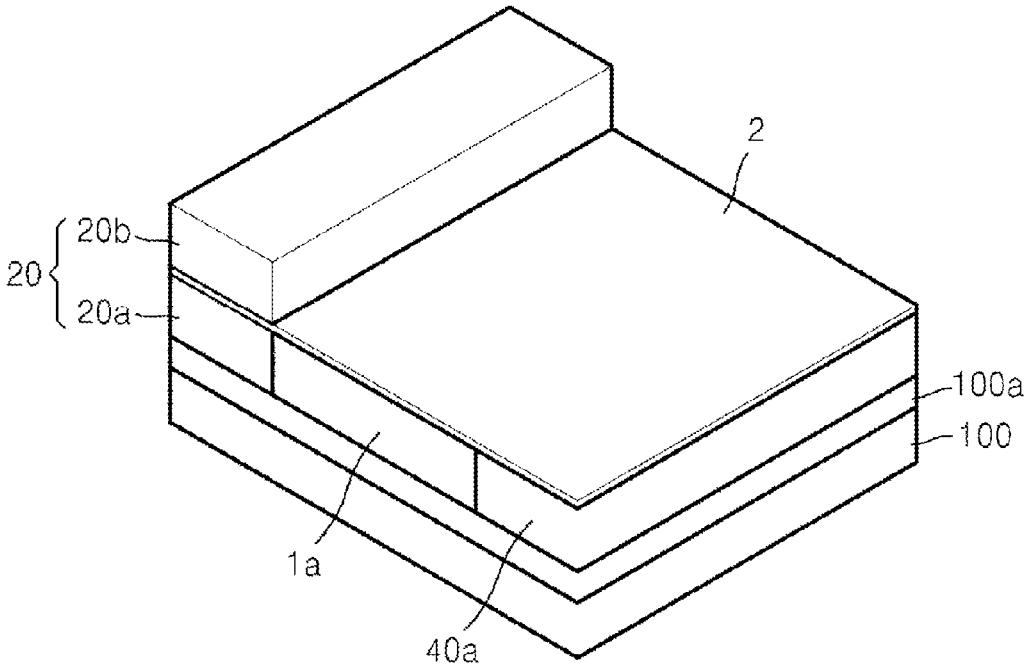

As illustrated in FIG. 3*e*, a second block 20*b*, which is an element of a cathode, is formed on the electron emission film 2 (the first surface thereof). The second block 20*b* may be formed of the same conductive material as that for the first block 20*a*, e.g., metals such as Au and Ag, through the same producing method as that for the first block 20*a*.

Figure 3F:
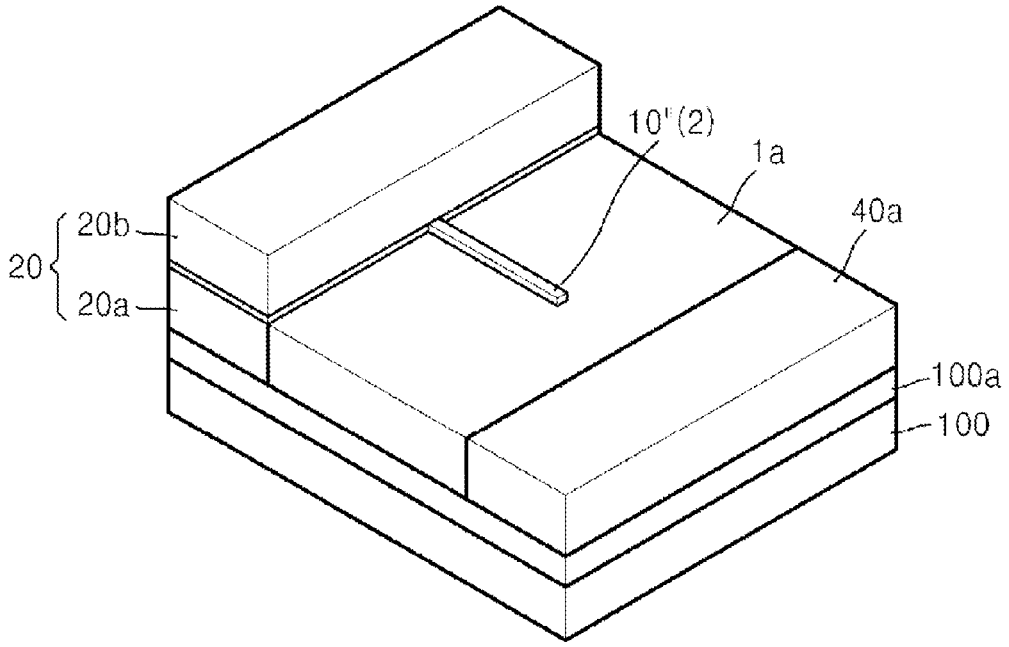
Figure 3G:
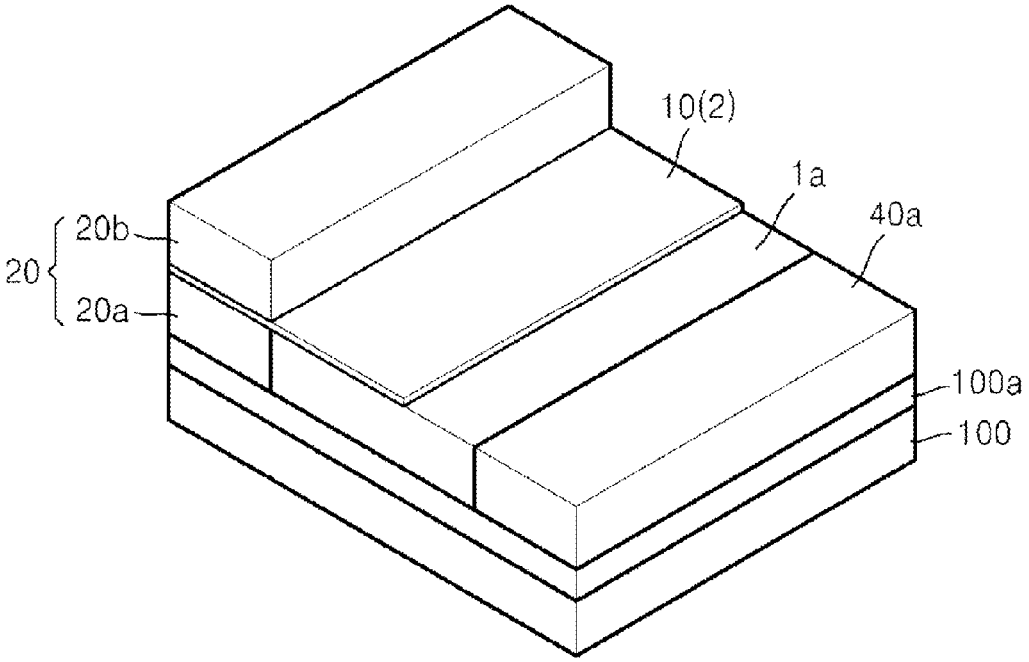
Figure 3H:
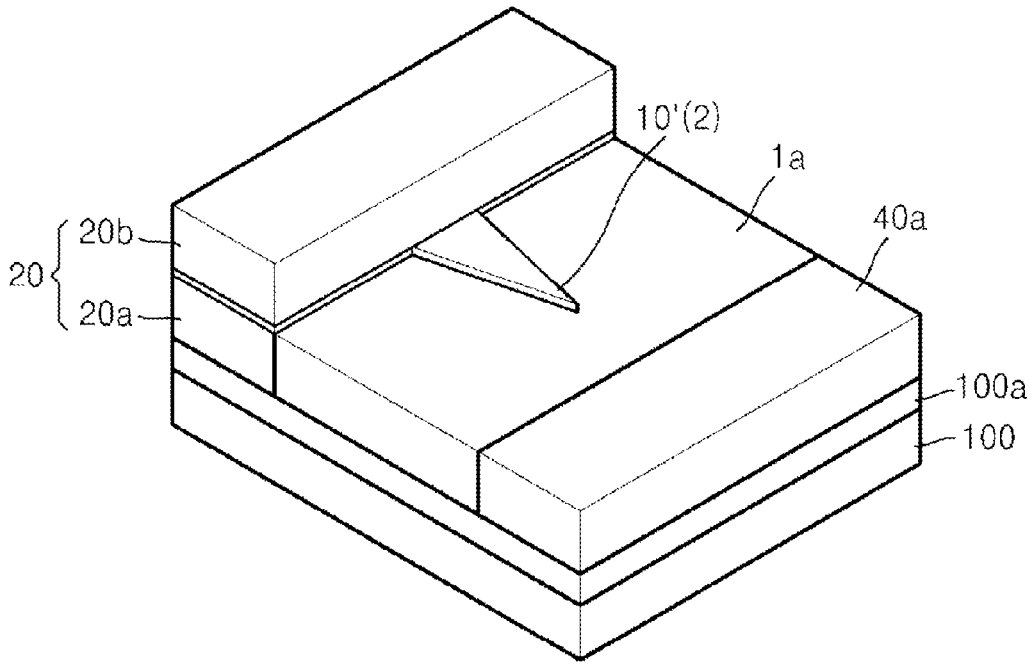

As illustrated in FIGS. 3*f*, 3*g* and 3*h*, the electron emission film 10, which is not covered with the second block 20*b*, is properly processed to be in a desired form, and the electron emission film 2 is separated from the first anode layer 40*a* so that the electron emission film 10, 10' and 10" completed in a desired form is obtained.

Figure 3I:
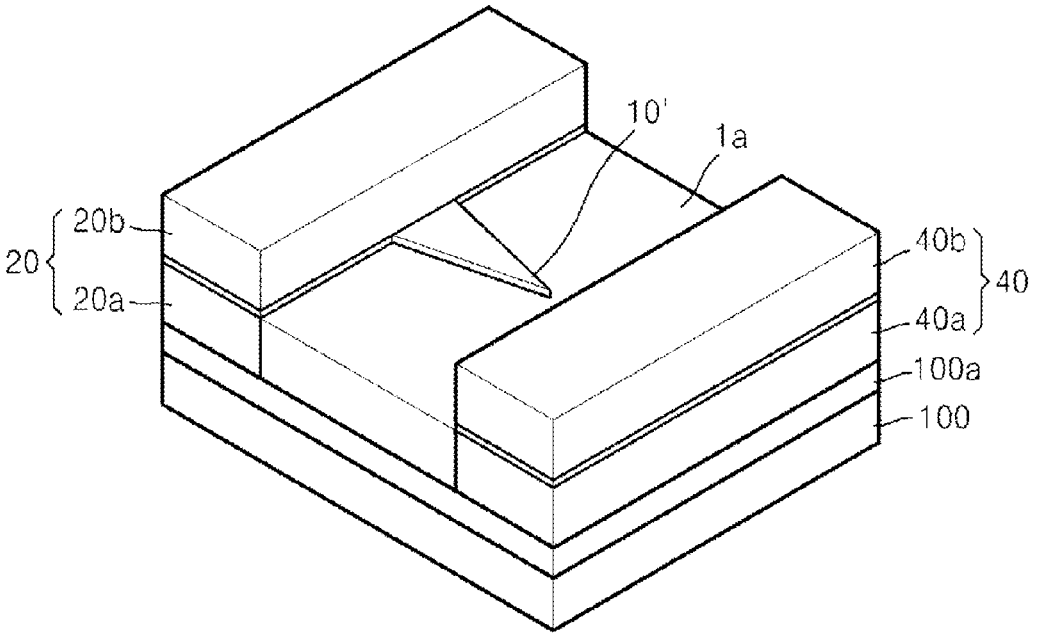

As illustrated in FIG. 3*i*, a second anode layer 40*b* is formed on the first anode layer 40*a* through a deposition method using a pattern mask or various patterning methods such as a photolithography method and electron beam lithography, which are generally known, so that an anode 40 having the first and second anode layers 40*a* and 40*b* is completed. The anode provides a side surface facing to an end of the electron emission film 10 by virtue of the first and second anode layers 40*a* and 40*b*. The second anode layer 40*b* of the anode 40 is identically formed in the structures illustrated in FIGS. 3*g* and 3*h*.

Figure 3J:
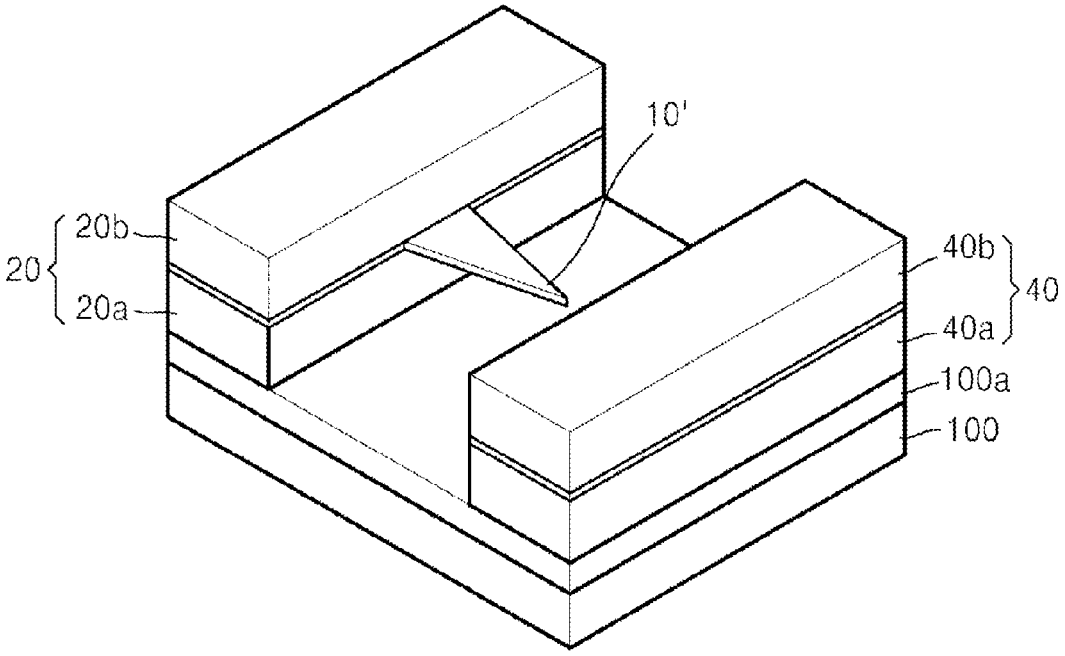

As illustrated in FIG. 3*j*, the sacrificial layer 1*a*, which supports the lower portion of the electron emission film 10, is removed so that a desired diode-structure electron emission device is completed.

FIGS. 4*a* to 4*h* schematically illustrate a process for producing a diode-structure field emission device, to which the electron emission source structure illustrated in FIG. 1*d* is applied.

Figure 4A:
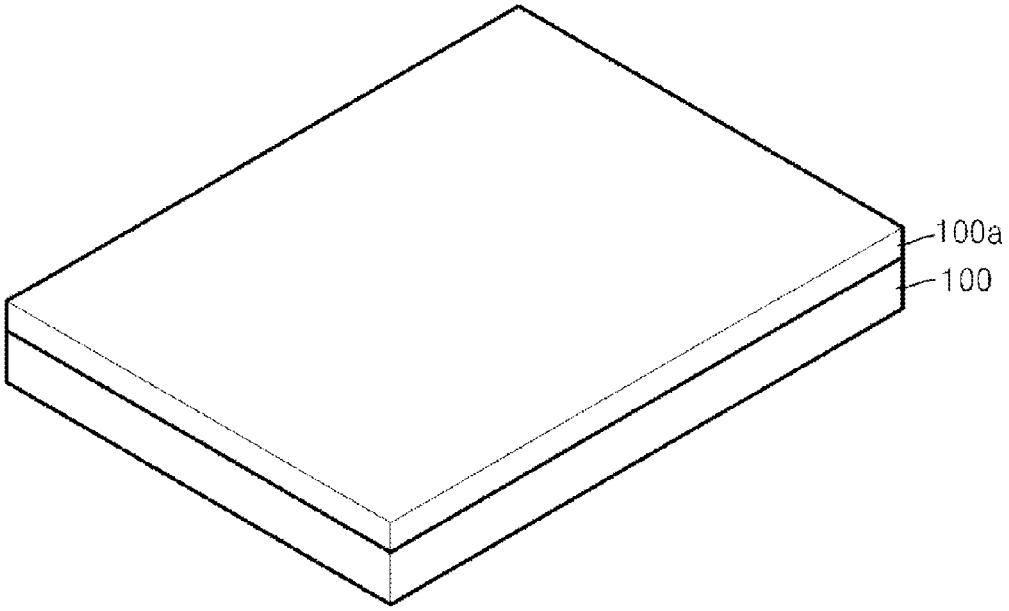
FIGS. 4*a* to 4*h* show an example of a method for fabricating an electron emission device in accordance with another illustrative embodiment of the present disclosure.

As illustrated in FIG. 4*a*, a silicon wafer 100 having a flat surface, on which a natural oxide film or an insulating layer 100*a* such as silicon dioxide ($SiO_2$) obtained from heat treatment to a silicon surface is formed, is prepared.

Figure 4B:
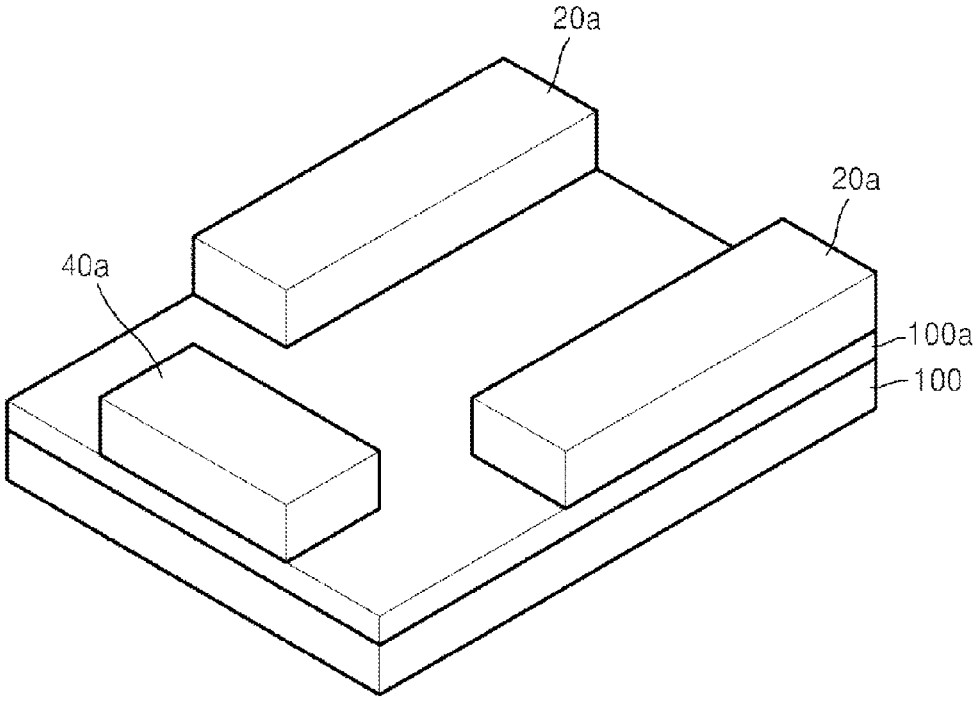

As illustrated in FIG. 4*b*, two first blocks 20*a*, which are elements of both cathodes, are formed on one side (the rear side in the drawing) of the insulating layer 100 with a certain space, and a first anode layer 40*a* is formed on the other side (the front side in the drawing) of the insulating layer 100*a*. At this time, the first blocks 20*a* and the first anode layer 40*a* are formed of the same conductive material, e.g., metals such as Au and Ag. To produce the first blocks 20*a* and the first anode layer 40*a*, a film formation method, to which a general patterning method is applied, a metal vacuum deposition method using a pattern mask or others may be used. As the film formation method, a thermal deposition method, an electron beam deposition method, or a physical deposition method such as a sputtering method is proper.

Figure 4C:
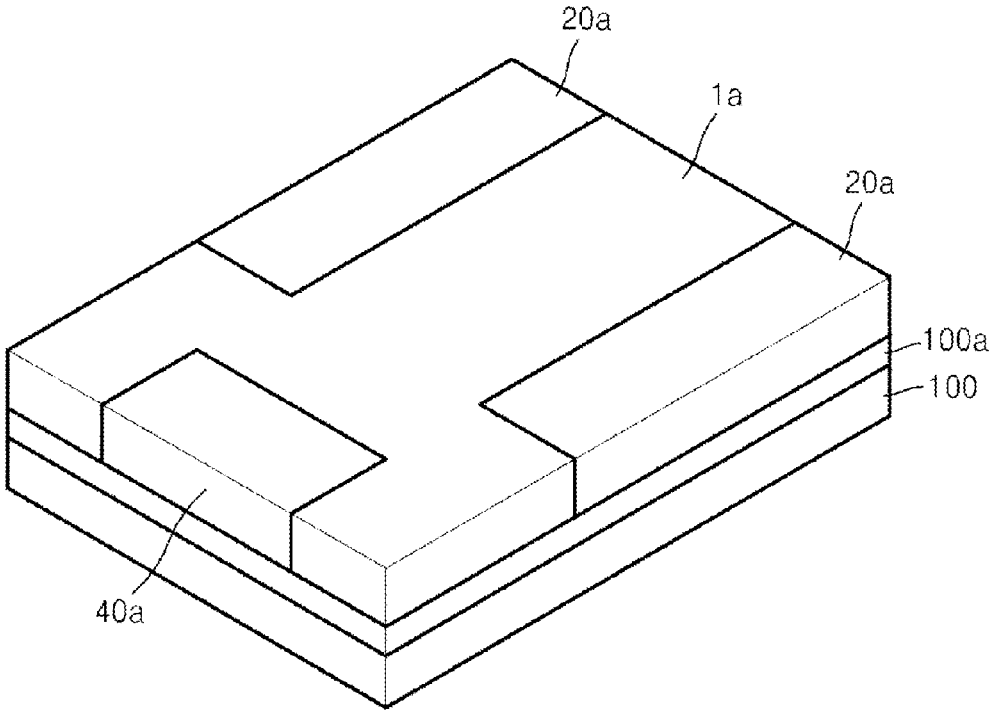

As illustrated in FIG. 4*c*, the space between the first blocks 20*a* and the first anode layer 40*a* is filled with an insulating material such as polymethyl metacrylate or SiNx to form a sacrificial layer 1*a*, which provides a flat surface between the first blocks 20*a* and the first anode layer 40*a*.

Figure 4D:
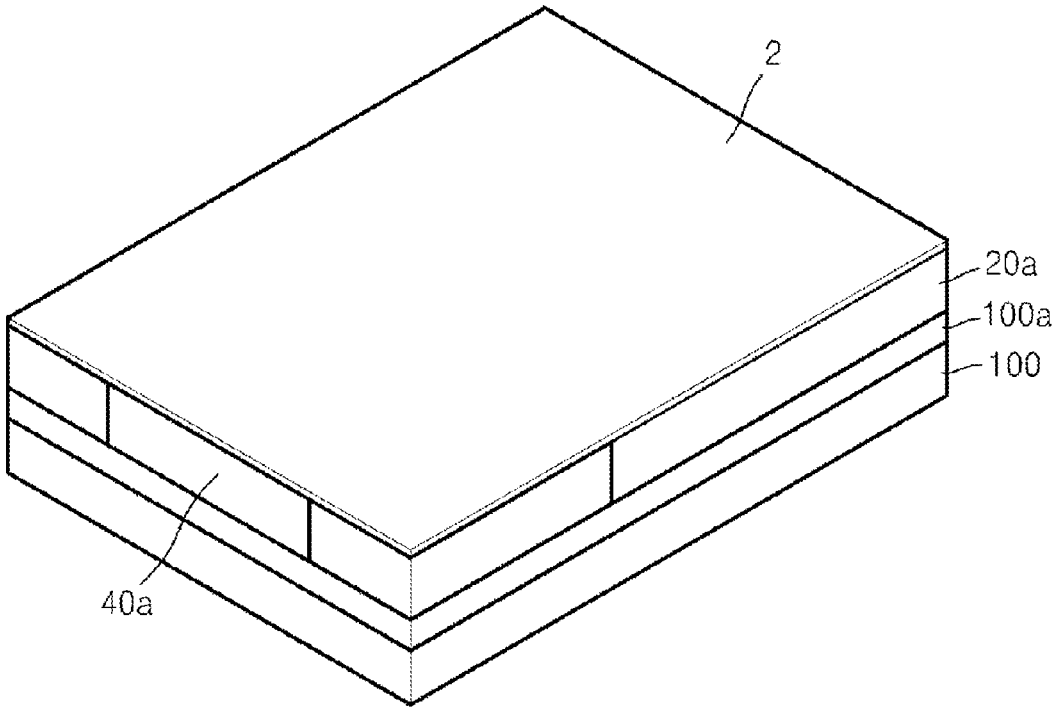

As illustrated in FIG. 4*d*, an electron emission film 2 in an initial form prior to completion is formed on the whole surface of the first blocks 20*a*, the first anode layer 40*a* and the sacrificial layer 1*a*. To produce the electron emission film 2, various known methods as mentioned in the above-described illustrated embodiment, e.g., suspension filtering, a simple suspension coating method, electrophoresis, and a transferring method may be applied. At this time, the electron emission film does not contain a binder for combining electron emission materials, and the electron emission materials are preferably combined to one another through a molecular force, i.e., the Van der Waals force. As the electron emission materials, nano-sized materials, which enable electron emission under a field, e.g., CNT, nanowires, and Graphene may be used.

Figure 4E:
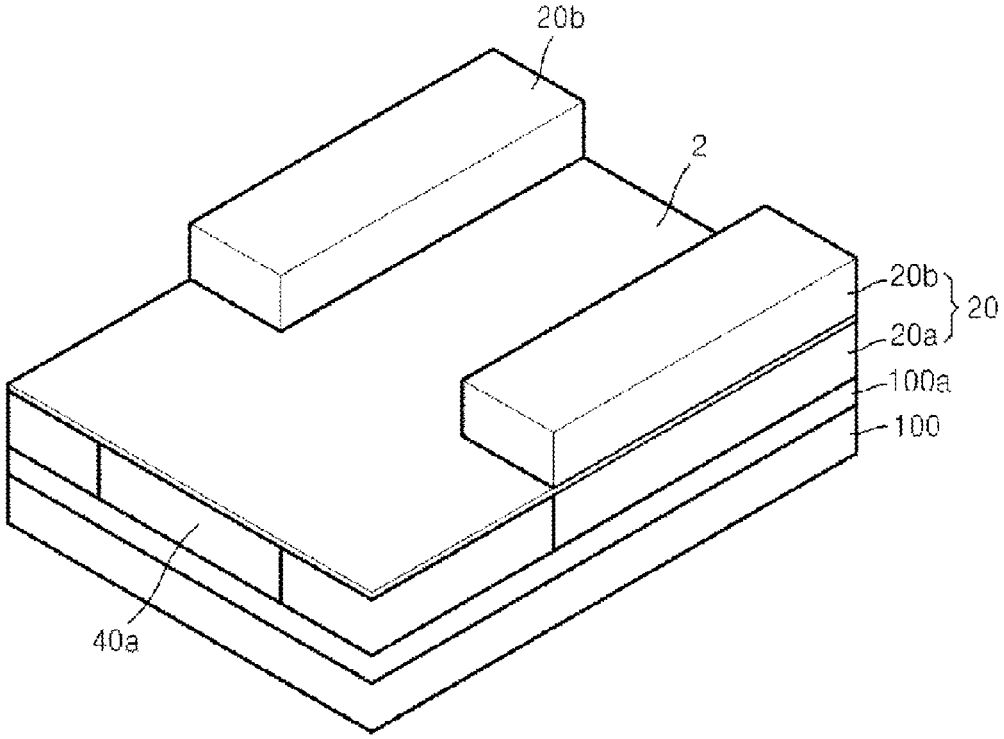

As illustrated in FIG. 4*e*, second blocks 20*b*, which are elements of the cathode 20, are formed on the electron emission film 2 (the first surface thereof) to correspond to the first blocks 20*a*, respectively. Both the second blocks 20*b* may be formed of the same conductive material as that for the first blocks 20*a*, e.g., metals such as Au and Ag through the same producing method as that for the first blocks 20*a*.

Figure 4F:
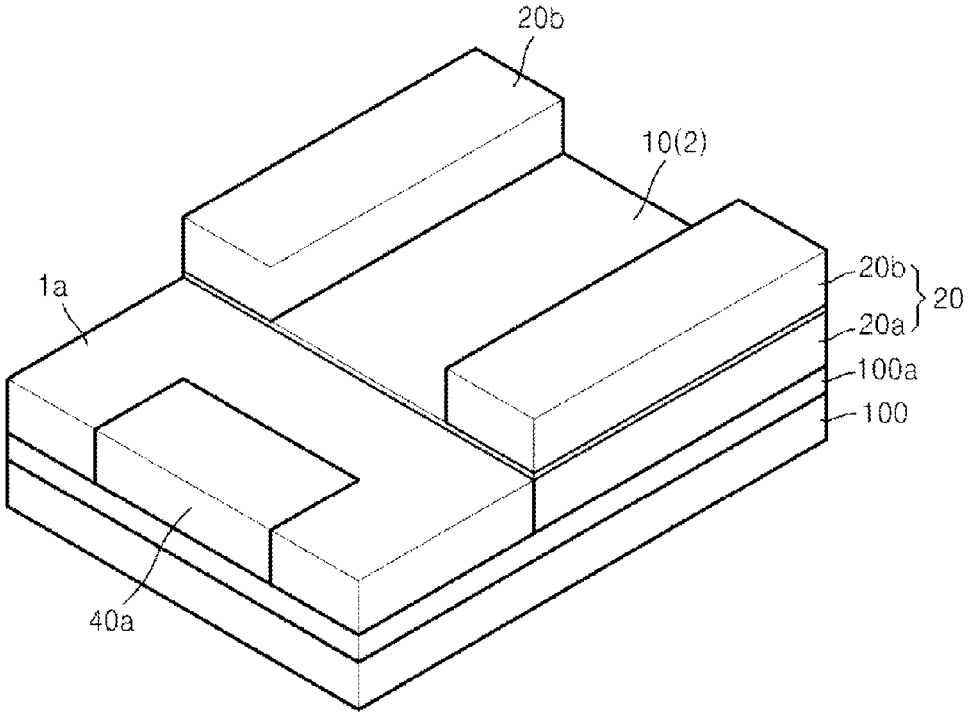

As illustrated in FIG. 4*f*, the electron emission film excluding the area between the second blocks 20*b* is removed so that the electron emission film 10 separated from the first anode layer 40*a* and completed in a desired form is obtained.

Figure 4G:
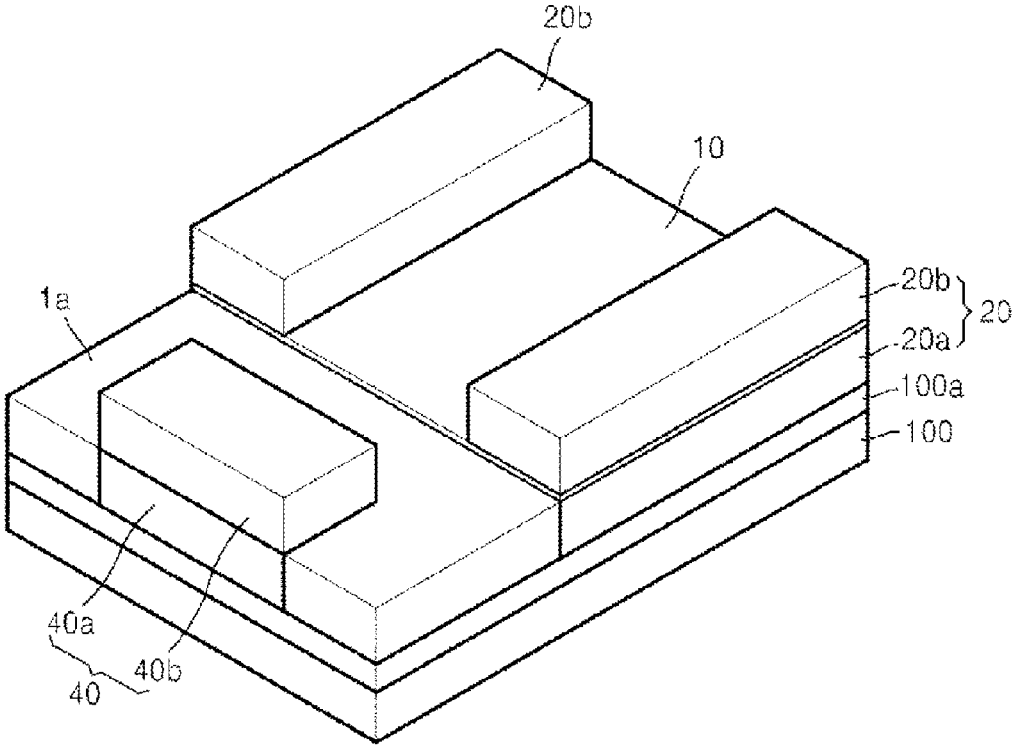

As illustrated in FIG. 4*g*, a second anode layer 40*b* is formed on the first anode layer 40*a* through a deposition method using a pattern mask or various patterning methods such as a photolithography method and electron beam lithography, which are generally known, so that an anode 40 having the first and second anode layers 40*a* and 40*b* and a side surface (electron incident surface) with a certain height is completed. The anode 40 provides a side surface facing to an end of the electron emission film 10 by virtue of the first and second anode layers 40*a* and 40*b*.

Figure 4H:
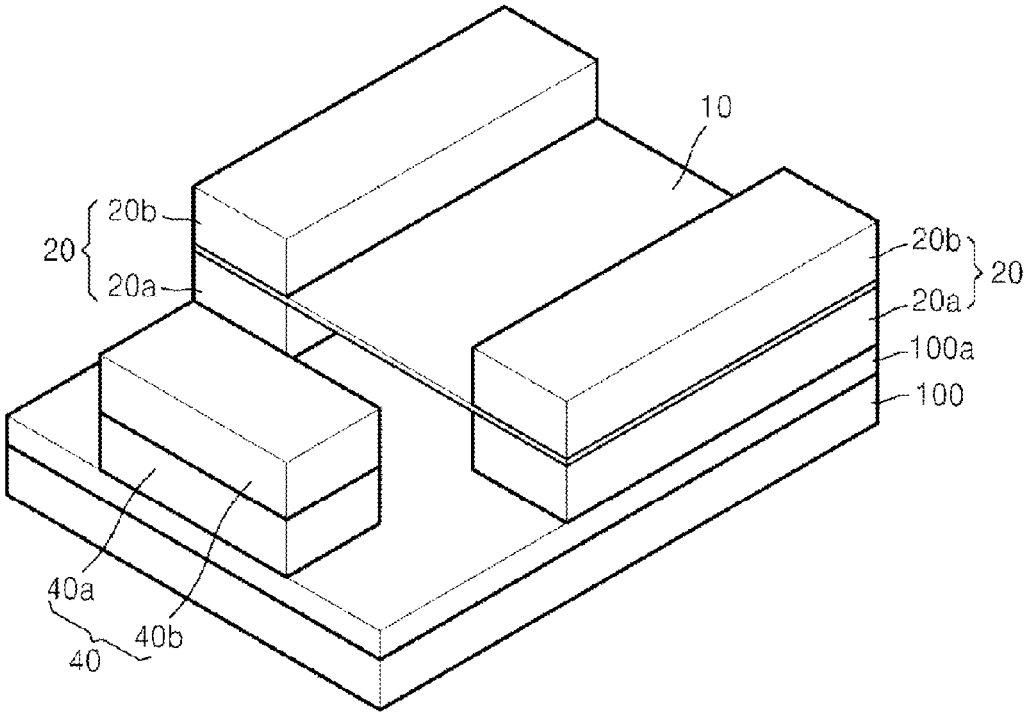

As illustrated in FIG. 4*h*, the sacrificial layer 1*a* supporting the lower portion of the electron beam film 10 and enclosing the anode is removed, so that a desired diode-structure electron emission device is completed.

The structure and the producing method that have been described relate to an electron emission source, which is a cathode structure, a structure of a diode-structure field emission device using the electron emission source, and a method for fabricating the field emission device. However, a structure of a triode-structure field emission device and a producing method thereof can be easily achieved by the structure and the producing method that have been described.

FIGS. 5*a*, 5*b*, 6*a* and 6*b* show examples for a triode-structure field emission device using the above-described electron emission source of the present disclosure.

Figure 5A:
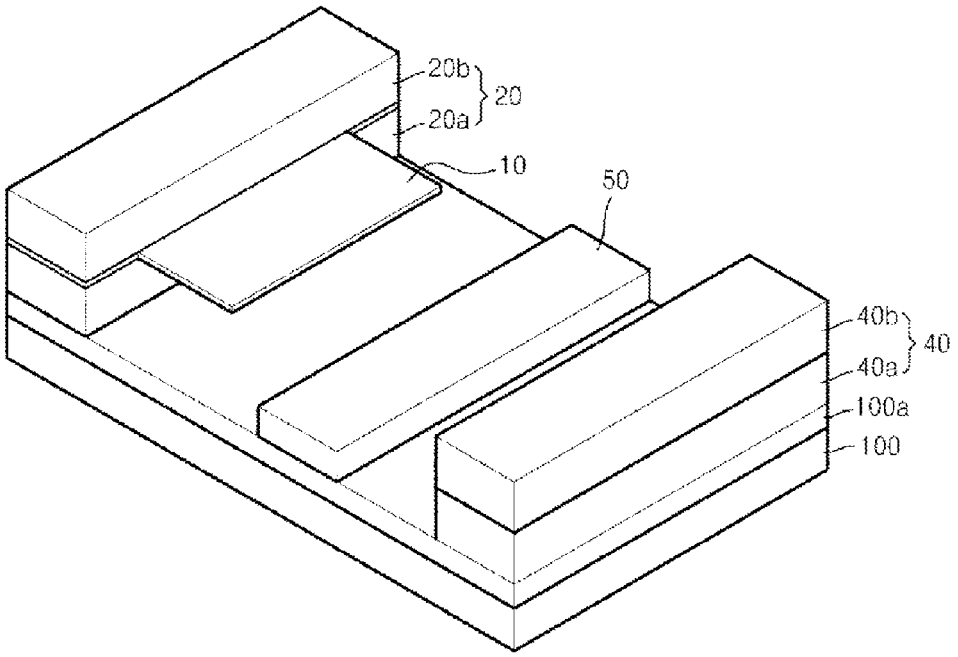
FIGS. 5*a* and 5*b* are a schematic perspective view and a side view of an electron emission device, respectively, in accordance with another illustrative embodiment of the present disclosure.
Figure 5B:
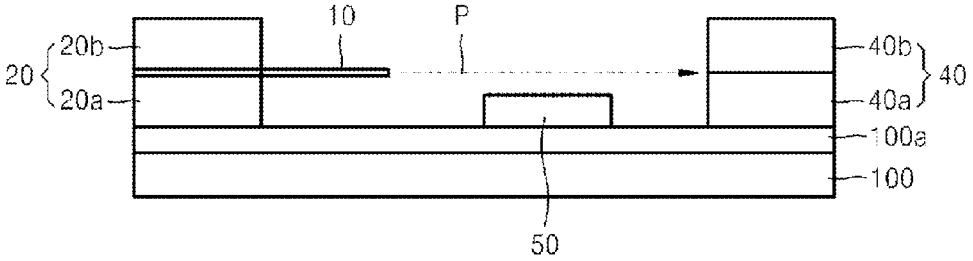

First, FIG. 5*a* schematically illustrates a horizontal field emission device having a triode structure in accordance with the present disclosure, and FIG. 5*b* is a side view of the field emission device.

With reference to FIGS. 5*a* and 5*b*, a bi-layer structure cathode 20 having a first block 20*a* and a second block 20*b*, which are formed of a conductive material, e.g., metals such as Au and Ag, and a bi-layer structure anode 40 having a first anode layer 40*a* and a second anode layer 40*b*, which are formed of a conductive material, e.g., metals such as Au and Ag, are provided on the substrate 100 provided with the insulating layer 100*a* while facing to each other at a certain distance. One end of the electron emission film 10 positioned in parallel with the substrate 100 is inserted between the first block 20*a* and second block 20*b* of the cathode and fixed thereto. A gate 50 is provided between the cathode 20 and the anode 40. The gate 50 is spaced at a certain distance from the front end of the electron emission film 10. The surface of the gate 50 has a height sufficient enough to form a proper gate (control) field on an electron passageway (P) between the end part of the electron emission film 10 and the anode 40. This height may be properly adjusted depending on a demand for design.

Figure 6A:
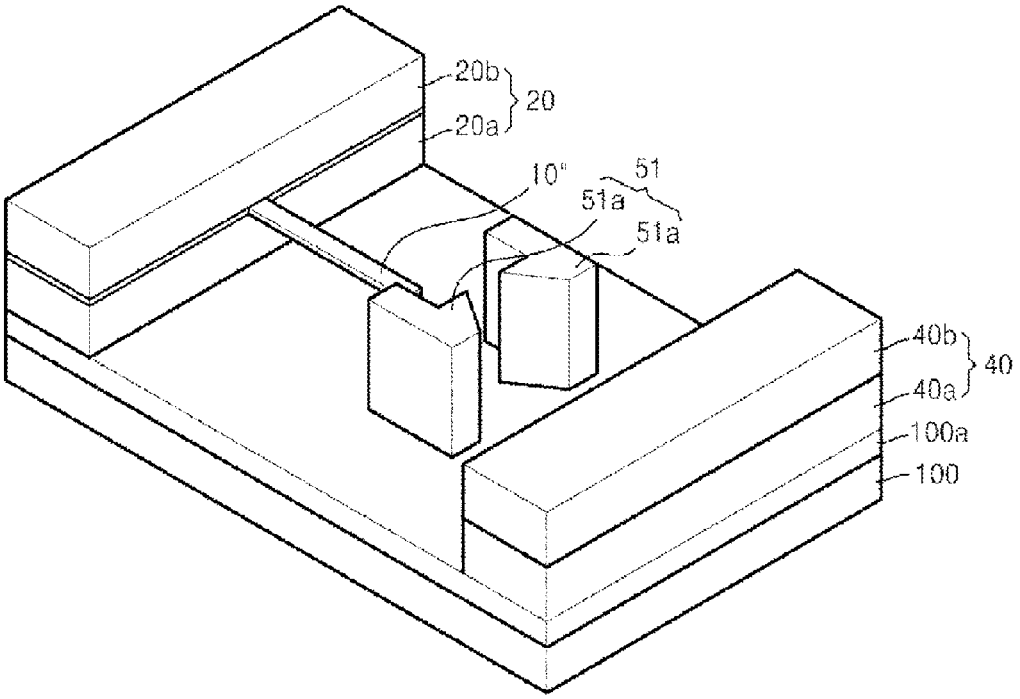
FIGS. 6*a* and 6*b* are a schematic perspective view and a plane view of an electron emission device, respectively, in accordance with another illustrative embodiment of the present disclosure.
Figure 6B:
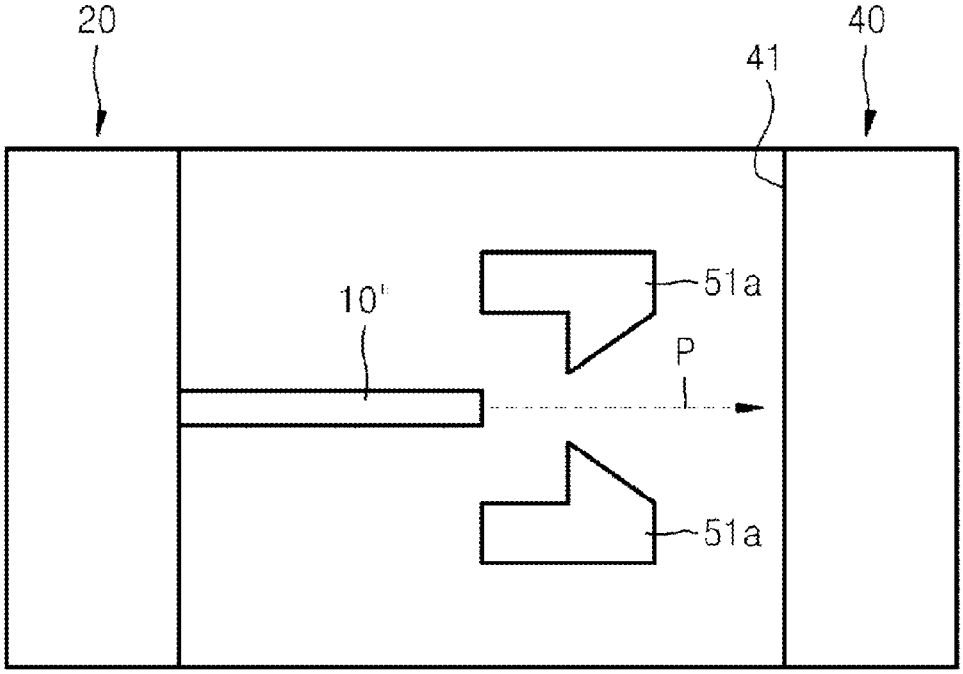

FIG. 6*a* schematically illustrates a horizontal field emission device having a different gate structure from that of the triode-structure field emission device illustrated in FIGS. 5*a* and 5*b*, and FIG. 6*b* is a plane view of the horizontal field emission device.

With reference to FIGS. 6*a* and 6*b*, the anode 40 having the first anode layer 40*a* and the second anode layer 40*b*, which are formed of metals such as Au and Ag, is provided on one side (the right side in the drawing) of the substrate 100. The cathode 20 having the first block 20*a* and the second block 20*b*, which horizontally fix the electron emission film 10", is provided on the other side of the substrate 100.

A gate 51 having gate members 51*a*, which are positioned at both sides of the electron passageway between the electron emission film 10" and the anode 40, is provided in the center of the substrate 100. The gate members 51*a* are electrically connected to each other, and the drawings omit the connection structure.

The gate members 51*a* may be formed of the same conductive material as that for the anode 40 and the cathode 20, e.g., metals such as Au and Ag. Both the gate members 51*a* are positioned at both the sides of the electron passageway (P)

while having a thickness (height) sufficient enough to fully cover the electron passageway (P) so as to form a field for controlling certain electrons on the electron passageway (P).

In accordance with another illustrative embodiment of the present disclosure, the above-described gate members may be separately produced, and thereafter, produced in the form that they are inserted between the electron emission film and the anode. Such a gate has a net structure, through which electron beams can penetrate, or is in a mesh shape. The mesh-shaped gate may be provided such that a plane surface thereof is vertical to an electron beam direction.

In realizing the electron emission device in accordance with the present disclosure, one end of the electron emission film is fixed between the two cathode blocks. Thus, the electron emission source in accordance with the present disclosure is superior in stability of the electron emission structure. Especially, since the electron emission film is formed of a pure electron emission material without containing a binder, there is no concern of outgassing caused by a binder or others.

In addition, since the electron emission film is produced by using a nano-material suspension in accordance with an illustrative embodiment of the present disclosure, the nano-sized electron emission materials are strongly combined to one another in a horizontal direction through the Van der Waals force and entanglement thereof. Accordingly, a strong bonding force is achieved even without requiring a conventional paste containing a binder in an organic material form or another additive. As a result, there are no problems such as contamination caused by the organic material, outgassing, or others, field emission efficiency is high, and the lifetime characteristic also becomes superior. In addition, since the electron emission materials are already arranged in a horizontal direction in the electron emission film, a separate follow-up process for forcibly standing the field emission source in a vertical direction is unnecessary. This simplifies processes and prevents contamination by foreign materials. Furthermore, since a great amount of electron emission materials substantially contribute to electron emission, the field emission efficiency becomes high, and the lifetime of the device becomes lengthened. Meanwhile, in accordance with another illustrative embodiment of the present disclosure, a binder may be contained in the electron emission film. Through a cutting process after production of a thin film according to the present disclosure, field emission sources in various forms can be easily produced, and a dot or linear light source can be produced.

Since the horizontal field electron emission device using the field emission source that has been described with reference to the above various illustrative embodiments can exclude a spacer, which has been required in a conventional vertical structure, a process for forming the spacer can be omitted. Especially, since the whole structure is formed on one substrate, the whole producing process can be simplified. Furthermore, since the whole structure is formed on one substrate, an array structure of multiple field emission devices can be obtained. If necessary, a large number of field emission devices can be produced by separating the array into individual devices.

The field electron emission device having the above-described structure can be applied to various fields, e.g., lamps, display devices, backlight devices for flat panel displays and electron sources for high power microwaves. In addition, since independent driving of selective individual devices and connection of individual devices are possible, integrated vacuum electron emission devices in the similar form to that of a solid semiconductor device can be realized.

What is claimed is:

1. A field emission device comprising:

an electron emission film containing nano-sized electron emission materials and having a first surface and a second surface opposite to the first surface;

a cathode comprising a first block and a second block corresponding to the first surface and the second surface of the electron emission film, respectively, to fix one end of the electron emission film;

a substrate that supports the cathode;

an anode formed on the other side of the substrate, facing to the electron emission film; and a gate formed between the cathode and the anode;

wherein an overlap area of the first block for the electron emission film corresponds to that of the second block for the electron emission film, the overlap areas correspond to only the one end of the electron emission film, and the cathode, the anode and the gate are located in a same surface of the substrate.

2. The field emission device of claim 1, wherein an end of the electron emission film is positioned facing to one side surface of the anode.

3. The field emission device of claim 2, wherein the gate comprises gate members provided at both sides of an electron passageway between the electron emission film and the anode.

4. The field emission device of claim 2, wherein the gate comprises a surface positioned at a lower portion of the electron passageway between the electron emission film and the anode.

5. The field emission device of claim 2, wherein the cathode is provided on both ends of the field emission film.

6. The field emission device of claim 2, wherein the electron emission materials of the electron emission film are combined to one another through a molecular force without requiring a binder.

7. The field emission device of claim 3, wherein the electron emission materials of the electron emission film are combined to one another through a molecular force without requiring a binder.

8. The field emission device of claim 4, wherein the electron emission materials of the electron emission film are combined to one another through a molecular force without requiring a binder.

9. The field emission device of claim 5, wherein the electron emission materials of the electron emission film are combined to one another through a molecular force without requiring a binder.

10. A method for fabricating a field emission device, the method comprising:

forming a first block, which is an element of a cathode, on one side of a substrate;

forming a sacrificial layer having a surface with the same height as that of the first block on a part, in which the first block is not formed;

forming an electron emission film by using electron emission materials on a surface of the first block and a surface of the sacrificial layer;

forming a second block corresponding to the first block on the electron emission film; and removing the sacrificial layer so that the electron emission film has a gap from the substrate, and fixing an end of the electron emission film in the state that it is inserted between the first and second blocks, wherein the forming the first block forms a first anode together on a position spaced from the first block, the forming the sacrificial layer forms the sacrificial layer on an area between the first block and the first anode, and the forming the electron emission film forms the electron emission film on a top surface of the first block, the first anode and the sacrificial layer.

11. The method for fabricating a field emission device as claimed in claim 10, wherein the method further comprises:

after the step of forming the second block and before the step of removing the sacrificial layer, separating the electron emission film from the first anode layer by processing the electron emission film; and forming a second anode layer having a height corresponding to the second block for fabricating a field emission device as claimed in claim 10, on the first anode.

* * * * *